US005429690A

United States Patent [19]

Heubner et al.

[11] Patent Number: 5,429,690

[45] Date of Patent: Jul. 4, 1995

[54] METHOD OF PRECIPITATION-HARDENING A NICKEL ALLOY

[76] Inventors: Ulrich Heubner, Borgheller Str. 28, 5980 Werdohl; Michael Köhler, Oestricher Str. 173, 5860 Iserlohn, both of Germany; Greg Chitwood, Belt Line & Webb Chapel Rds., P.O. Box 19052, Dallas, Tex. 75234; Jon Bryant, 10 Sylvan Way, Parsippany, N.J. 07054

[21] Appl. No.: 582,862

[22] PCT Filed: Mar. 23, 1989

[86] PCT No.: PCT/DE89/00188

§ 371 Date: Jun. 9, 1992

§ 102(e) Date: Jun. 9, 1992

[87] PCT Pub. No.: WO89/09292

PCT Pub. Date: Oct. 5, 1989

[30] Foreign Application Priority Data

Mar. 26, 1988 [DE] Germany ..... 38 10 336.2

[51] Int. Cl.[6] ..... C21D 9/00

[52] U.S. Cl. ..... 148/677; 148/707

[58] Field of Search ..... 148/707, 677, 410, 428, 148/419, 442; 420/580, 582, 584.1, 586, 586.1

[56] References Cited

U.S. PATENT DOCUMENTS

| | | | |
|---|---|---|---|
| 2,777,766 | 1/1957 | Binder . | |
| 2,977,222 | 3/1961 | Bieber | 420/449 |
| 4,421,571 | 12/1983 | Kudo et al. | 148/707 |
| 4,652,315 | 3/1987 | Igarashi et al. | 148/707 |
| 4,750,950 | 6/1988 | Clatworthy et al. | 148/707 |

FOREIGN PATENT DOCUMENTS

| | | | |
|---|---|---|---|
| 546036 | 3/1956 | Belgium . | |
| 52941 | 6/1982 | European Pat. Off. . | |
| 132055 | 1/1985 | European Pat. Off. . | |
| 184136 | 6/1986 | European Pat. Off. . | |
| 57-207143 | 12/1982 | Japan . | |
| 61-201759 | 9/1986 | Japan | C22C 38/44 |
| 62-023950 | 1/1987 | Japan | C22C 38/44 |
| 8301757 | 5/1983 | Netherlands | C22C 30/00 |
| 531466 | 5/1941 | United Kingdom . | |

OTHER PUBLICATIONS

The Development of a Corrosion Resistant Alloy for Sour Gas Service, CORROSION 84, paper No. 216, National Association of Corrosion Engineers, Houston, Tex., 1984.

Properties of an Age-Hardenable, Corrosion-Resistant, Nickel-Base Alloy, CORROSION 88, Paper No. 75, National Association of Corrosion Engineers, Houston, Tex., 1988.

*Primary Examiner*—Melvyn J. Andrews
*Assistant Examiner*—Margery S. Phipps
*Attorney, Agent, or Firm*—Meltzer, Lippe, Goldstein, Wolf, Schlissel & Sazer

[57] ABSTRACT

The Application relates to a precipitation hardening alloy which has a 0.2% proof stress of at least 500 $N/mm^2$ and a high resistance to corrosion in highly aggressive sour gas media. The alloy consists of 43 to 51% nickel, 19 to 24% chromium, 4.5 to 7.5% molybdenum, 0.4 to 2.5% copper, 0.3 to 1.8% aluminium and 0.9 to 2.2% titanium, residue iron. Heat treatment processes are described which allow the establishment in the alloy of high strength accompanied by satisfactory ductility.

6 Claims, No Drawings

METHOD OF PRECIPITATION-HARDENING A NICKEL ALLOY

BACKGROUND OF THE INVENTION

1. Field of the Invention

The invention relates to a precipitation hardening nickel alloy having a 0.2% proof stress of at least 500 $N/mm^2$ and very good resistance to corrosion, the invention also relating to the use of said alloy for the making of structural components required to meet the aforementioned demands and to a process for the production of such structural components.

Very high resistance to corrosion means that the alloy and components made thereof can be exposed at temperatures between room temperature and 350° C. and pressures between 10 and 100 bar to solutions containing $CO_2$, $H_2S$, chlorides and free sulfur.

Such conditions are typically found in oil and natural gas exploration and production. Structural components meeting the aforementioned conditions have hitherto been made from nickel-based materials alloyed with chromium and molybdenum, although their 0.2% proof stress is only approximately 310 to 345 $N/mm^2$. Their strength can be enhanced by cold working, although at the same time a reduction in ductility must be tolerated. Moreover, as a rule strain hardening cannot be used with very large cross-sections, so that in such cases precipitation hardening materials must be resorted to. However, in highly aggressive sour gas conditions materials which can be given higher strengths by precipitation hardening have inadequate resistance to corrosion, or they contain niobium as an essential alloying element required for precipitation hardening.

2. Description of the Prior Art

For example, J. A. Harris, T. F. Lemke, D. F. Smith and R. H. Moeller proposed a precipitation hardening nickel-based material containing 42% nickel, 21% chromium, 3% molybdenum, 2.2% copper, 2.1% titanium, 0.3% aluminium, 0.02% carbon, residue iron, which was alleged to be resistant in sour gas conditions (The Development of a Corrosion Resistant Alloy for Sour Gas Service, CORROSION 84, Paper No. 216, National Association of Corrosion Engineers, Houstin, Tex., 1984). However, their published results show that in conditions of extreme corrosion, such as may exist at greater depths, the material proposed is destroyed by stress corrosion cracking.

Another alloy was proposed in European Patent Specification 0066361. That proposed alloy contained (in % by weigh) in addition to 45 to 55% nickel, 15 to 22% chromium, 6 to 9% molybdenum, 2.5 to 5.5% niobium, 1 to 2% titanium, up to 1% aluminium, up to 0.35% carbon and 10 to 28% iron and other accompanying elements, also niobium as an alloying component essential for precipitation hardening. However, niobium-containing alloys are much less suitable for large scale industrial manufacture and processing than niobium-free alloys, since niobium-containing scrap and production wastes require a vacuum induction furnace for remelting if appreciable losses of this expensive alloying element by burn-off are to be avoided. Moreover, higher niobium contents, such as those here proposed, very clearly reduce the possibilities of hot shaping of the material. Similar disadvantages also apply to the alloy proposed by R. B. Frank and T. A. DeBold which have (in % by weight) 59 to 63% nickel, 19 to 22% chromium, 7 to 9.5% molybdenum, 2.75 to 4% niobium, 1 to 1.6% titanium, maximum 0.35% aluminium, maximum 0.03% carbon, residue iron (Properties of an Age-Hardenable, Corrosion-Resistant, Nickel-Base Alloy, CORROSION, 88 Paper No. 75, National Association of Corrosion Engineers, Houston, Tex., 1988). Due to its high nickel content, this alloy can also be expected to have a marked tendency towards hydrogen embrittlement in sour gas conditions in the temperature range below approximately 100° C., so that in this respect it has limited utilizability.

The problem therefore exists of providing a precipitation hardening material which meets all the aforementioned requirements—i.e., has the required strength values, adequate resistance to corrosion in highly aggressive sour gas conditions, and requires no niobium for precipitation hardening.

SUMMARY OF THE INVENTION

To solve this problem the invention provides a precipitation hardening nickel alloy which is characterized by 43 to 51% nickel
19 to 24% chromium
4.5 to 7.5% molybdenum
0.4 to 2.5% copper
up to 1% manganese
up to 0.5% silicon
up to 0.02% carbon
up to 2% cobalt
0.3 to 1.8% aluminium
0.9 to 2.2% titanium
residue iron, including unavoidable impurities due to manufacture.

The nickel alloy according to the invention is suitable as a material for the making of structural components which must have a 0.2% proof stress of at least 500 $N/mm^2$, an elongation without necking $A_5$ of at least 20%, a reduction of area after fracture of at least 25% and an absorbed energy per cross-sectional area at room temperature of at least 54 J, corresponding to at least 40 ft lbs, with ISO V specimens.

A limited composition having particularly satisfactory workability properties is characterized by 46 to 51% nickel
20 to 23.5% chromium
5 to 7% molybdenum
1.5 to 2.2% copper
up to 0.8% manganese
up to 0.1% silicon
up to 0.015% carbon
up to 2% cobalt
0.4 to 0.9% aluminium
1.5 to 2.1% titanium
residue iron, including unavoidable impurities due to manufacture.

This can be used if the requirements are for a 0.2% proof stress of at least 750 $N/mm^2$, an elongation without necking $A_5$ of at least 20%, a reduction of area after fracture of at least 25% and an absorbed energy per cross-sectional area at room temperature of at least 54 H, corresponding to at least 40 ft lbs, with ISO V samples.

The nickel alloy is more particularly suitable as a material for the making of structural components which are to be used in highly aggressive sour gas conditions.

In the manufacture of structural components which must have an adequate resistance to corrosion in highly aggressive sour gas conditions and a 0.2% proof stress of at least 500 N/mm$^2$, conveniently the procedure is that ingots are produced from an alloy having 43 to 51% nickel
19 to 24% chromium
4.5 to 7.5% molybdenum
0.4 to 2.5% copper
up to 1% manganese
up to 0.5% silicon
up to 0.02% carbon
up to 2% cobalt
0.3 to 1.8% aluminium
0.9 to 2.2% titanium
residue iron, including unavoidable impurities due to manufacture.

The ingots are homogenized at 1120° C. and then hot shaped at a temperature above 1000° C., the resulting components being quenched in water, and the hot shaped quenched components are precipitation hardened for 4 to 16 hours at 650° to 750° C. and then subjected to air cooling.

For ingots which must have particularly good workability properties, preferably the following alloy is used, having 46 to 51% nickel
20 to 23.5% chromium
5 to 7% molybdenum
1.5 to 2.2% copper
up to 0.8% manganese
up to 0.1% silicon
up to 0.015% carbon
up to 2% cobalt
0.4 to 0.9% aluminium
1.5 to 2.1% titanium
residue iron, including unavoidable impurities due to manufacture.

In addition to the single-stage heat treatment mentioned, the mechanical and technological properties can be further improved by additional precipitation hardening steps. In that case the hot shaped, quenched components are first annealed for 4 to 10 hours at 700° to 750° C., then furnace-cooled in a controlled manner by 150° C. at a rate of 5° to 25° C. per hour, and finally deposited in air. Alternatively, the structural components can also be held between 730° and 750° C. for 30 minutes, then furnace-cooled to 700° C. at a rate of 5° to 25° C. per hour, and finally cooled in a controlled manner to 580° C. at a rate of 2° to 15° C. per hour. Finally the structural components are deposited in air.

In a further variant of the manufacturing process, prior to being quenched in water, the hot shaped components are subjected to a solution annealing at 1150° to 1190° C. Lastly according to a possible feature of the invention the hot shaped solution-annealed water-quenched components are held for 4 to 10 hours at 700° to 750° C., then furnace-cooled by 150° C. at a rate of 5° to 25° C. per hour and finally subjected to further air cooling.

Other details and advantages of the invention will be explained in greater detail with reference to the following test results.

DESCRIPTION OF THE PREFERRED EMBODIMENTS

Table 1 shows the chemical composition of 7 alloys which after different heat treatments were investigated for their mechanical properties at room temperature (RT) and at 260° C. The results are set forth in Tables 2 to 7.

From ingots weighing approximately 45 kg, following solution annealing at 1220° C., rods having a diameter of approximately 18 mm were hot forged at temperatures above 1000° C. Thereafter the rods were either quenched directly in water or again solution annealed and then quenched in water. Subsequently the samples thus prepared were subjected to a single to triple stage precipitation hardening treatment. In the first stage annealing temperatures of 730° or 750° C. and annealing times of 8, 4 or 0.5 hours were used. In the case of the two-stage process this was followed by a controlled cooling at the rate of 15° C. per hour to 600° or 580° C., while in the triple stage process first a controlled cooling at 700° C. at the rate of 5° C. per hour and then a further controlled cooling to 580° C. at the rate of 15° C. per hour were performed before the samples were subjected to further uncontrolled cooling in air.

The results show that in all cases the required minimum values of the mechanical properties were achieved and in some cases appreciably exceeded. Furthermore, results as a whole show that the different variants of the heat treatment enable different values of mechanical properties to be achieved, something which may be advantageous for adjustment to specially required sections. For example, higher elongation values at rupture can be achieved at the expense of maximum strength values and vice versa. Apart from this general tendency, however, it can be seen that the highest strength values are achieved if the hot shaped components are not yet even solution annealed, but directly quenched in water, while the maximum achievable strength depends on the total content of aluminium plus titanium.

However, the aluminium and titanium contents cannot be increased to just any extent, since in that case disadvantageous precipitation phases occur which cannot be prevented or compensated even by an expensive heat treatment. On the other hand, due to the numerous alternative heat treatments, within the framework of the composition according to the invention it is always possible to obtain maximum strength values in every case without having to allow for disadvantageous structures. Thus, the more expensive triple stage precipitation hardening treatment will be indicated, for example, if the objective is to obtain the highest possible strength values without a reduction of the absorbed energy per cross-sectional area.

To examine resistance to stress corrosion cracking, three-point bending samples were tested with two different corrosive media in an autoclave. In dependence on the preceding heat treatment, the samples were subjected to different test loads, the values 100% $R_{p0.2}$ and also 120% $R_{p0.2}$ having been selected as reference values. The test temperatures were 232° C. and 260° C.

The solutions A and B by which the sour gas conditions were simulated contained:

Solution A: 25% NaCl, 10 bar $H_2S$ and 50 bar $CO_2$
Solution B: 25% NaCl, 0.5% acetic acid, 1 g/l sulfur and 12 bar $H_2S$.

Tables 8 to 13 show the results of these corrosion investigations, stating the test conditions.

It can be seen that following the test cycle of between 23 and 26 days none of the samples showed any rupture or any attack pointing to stress corrosion cracking.

The alloy according to the invention therefore discloses in a novel manner a combination of high strength and outstanding resistance in highly aggressive sour gas media hitherto unachieved using precipitation hardening materials.

TABLE 1

| | Composition of the examples in % by weight | | | | | | | | | | |
|---|---|---|---|---|---|---|---|---|---|---|---|
| Alloy No. | Ni | Cr | Fe | Mo | Mn | Si | Cu | C | Al | Ti | Al + Ti |
| 1 | 46.6 | 22.1 | residue | 7.4 | 0.48 | 0.10 | 2.0 | 0.007 | 0.40 | 1.80 | 2.20 |
| 2 | 49.1 | 20.7 | " | 6.0 | 0.49 | 0.05 | 1.8 | 0.008 | 0.62 | 1.73 | 2.35 |
| 3 | 44.9 | 23.3 | " | 7.1 | 0.52 | 0.11 | 2.0 | 0.014 | 0.53 | 2.01 | 2.54 |
| 4 | 47.4 | 22.3 | " | 6.1 | 0.49 | 0.05 | 1.8 | 0.011 | 0.64 | 1.95 | 2.59 |
| 5 | 45.0 | 23.3 | " | 7.1 | 0.49 | 0.10 | 2.0 | 0.015 | 1.01 | 1.97 | 2.98 |
| 6 | 45.7 | 23.1 | " | 7.0 | 0.48 | 0.08 | 2.0 | 0.011 | 1.10 | 1.90 | 3.00 |
| 7 | 45.3 | 23.0 | " | 7.1 | 0.45 | 0.08 | 2.0 | 0.011 | 1.60 | 2.00 | 3.60 |

TABLE 1

Mechanical properties at room temperature (RT)
Heat treatment: (last step always air cooling)
a) Hot shaping, solution annealing and aging for Y hours at X° C.,
b) Hot shaping, solution annealing and aging for Y hours at X° C., followed by controlled cooling with $Z_1$° C./h to $X_1$° C.

| Alloy No. | Heat treatment | X °C. | Y h | $Z_1$ °C./h | $X_1$ °C. | $R_m$ N/mm² | $R_{p0.2}$ N/mm² | $A_5$ % | Z % | $H_V30$ |
|---|---|---|---|---|---|---|---|---|---|---|
| 1 | a | 730 | 8 | — | — | 1020 | 552 | 37.0 | 44.0 | 280 |
| | a | 730 | 14 | — | — | 1042 | 592 | 33.5 | 47.5 | 271 |
| | b | 730 | 8 | 15 | 595 | 1058 | 586 | 35.6 | 47.0 | 323 |
| | b | 750 | 4 | 15 | 600 | 1117 | 661 | 38.0 | 48.0 | 307 |
| 6 | a | 730 | 8 | — | — | 1082 | 655 | 38.0 | 51.0 | 302 |
| | a | 750 | 8 | — | — | 1130 | 669 | 29.0 | 39.0 | 311 |
| | b | 750 | 4 | 15 | 600 | 1165 | 732 | 17.3 | 16.0 | 308 |
| | b | 750 | 8 | 15 | 600 | 1177 | 740 | 22.0 | 22.0 | 334 |
| 7 | a | 730 | 8 | — | — | 1063 | 672 | 37.0 | 51.0 | 313 |
| | a | 750 | 8 | — | — | 1171 | 749 | 30.0 | 31.0 | 331 |
| | b | 750 | 4 | 15 | 600 | 1185 | 862 | 7.0 | 5.2 | 381 |
| | b | 750 | 8 | 15 | 600 | 1247 | 844 | 17.5 | 15.0 | 372 |

TABLE 2

Mechanical properties at 260° C.
Heat treatment: (last step always air cooling)
a) Hot shaping, solution annealing and aging for Y hours at X° C.,
b) Hot shaping, solution annealing and aging for Y hours at X° C., followed by controlled cooling with $Z_1$° C./h to $X_1$° C.

| Alloy No. | Heat treatment | X °C. | Y h | $Z_1$ °C./h | $X_1$ °C. | $R_m$ N/mm² | $R_{p0.2}$ N/mm² | $A_5$ % | Z % | $H_V30$* |
|---|---|---|---|---|---|---|---|---|---|---|
| 1 | a | 730 | 8 | — | — | 894 | 483 | 37.0 | 49.0 | 277 |
| | a | 730 | 14 | — | — | 928 | 530 | 36.0 | 47.0 | 280 |
| | b | 730 | 8 | 15 | 595 | 953 | 547 | 32.4 | 40.0 | 296 |
| | b | 750 | 4 | 15 | 600 | 1003 | 621 | 32.0 | 49.0 | 327 |
| 6 | a | 730 | 8 | — | — | 984 | 575 | 36.0 | 46.0 | 308 |
| | a | 750 | 8 | — | — | 1043 | 605 | 32.0 | 35.0 | 305 |
| | b | 750 | 4 | 15 | 600 | 1125 | n.b. | 15.0 | 19.0 | 345 |
| | b | 750 | 8 | 15 | 600 | 1084 | 658 | 20.5 | 20.0 | 335 |
| 7 | a | 730 | 8 | — | — | 999 | 630 | 36.0 | 48.0 | 303 |
| | a | 750 | 8 | — | — | 1100 | 682 | 25.5 | 28.0 | 340 |
| | b | 750 | 4 | 15 | 600 | 1096 | 909 | 3.0 | 5.0 | 381 |
| | b | 750 | 8 | 15 | 600 | 1141 | 766 | 12.5 | 17.0 | 366 |

*) = Hardness measurement performed at RT

TABLE 4

Mechanical properties at room temperature (RT)
Heat treatment: (last step always air cooling)
b) Hot shaping, solution annealing and aging for Y hours at X° C., followed by controlled cooling with $Z_1$° C./h to $X_1$° C.,
c) Hot shaping, water quenching, aging for Y hours at X° C., followed by controlled cooling with $Z_1$° C./h to $X_1$° C.,
d) as c), but with further controlled cooling from $X_1$ with $Z_2$° C./h to $X_2$° C.

| Alloy No. | Heat treatment | X °C. | Y h | $Z_1$ °C./h | $X_1$ °C. | $Z_2$ °C/h | $X_2$ °C. | $R_m$ N/mm² | $R_{p0.2}$ N/mm² | $A_5$ % | Z % | $H_V30$ |
|---|---|---|---|---|---|---|---|---|---|---|---|---|
| 3 | b | 730 | 8 | 15 | 580 | — | — | 1084 | 593 | 31.5 | 32.0 | 341 |
| | c | 730 | 8 | 15 | 580 | — | — | 1191 | 916 | 25.3 | 33.0 | 390 |
| | d | 730 | 4 | 5 | 700 | 15 | 580 | 1166 | 8641 | 22.1 | 29.0 | 361 |
| | b | 750 | 4 | 15 | 600 | — | — | 1139 | 650 | 27.5 | 31.0 | 354 |
| | c | 750 | 4 | 15 | 600 | — | — | 1182 | 949 | 22.5 | 30.0 | 401 |
| | d | 750 | 0.5 | 5 | 700 | 15 | 580 | 1143 | 820 | 23.6 | 31.0 | 368 |
| 5 | b | 730 | 8 | 15 | 580 | — | — | 1123 | 682 | 26.0 | 24.0 | 343 |

TABLE 4-continued

Mechanical properties at room temperature (RT)
Heat treatment: (last step always air cooling)
b) Hot shaping, solution annealing and aging for Y hours at X° C., followed by controlled cooling with $Z_1$° C./h to $X_1$° C.,
c) Hot shaping, water quenching, aging for Y hours at X° C., followed by controlled cooling with $Z_1$° C./h to $X_1$° C.,
d) as c), but with further controlled cooling from $X_1$ with $Z_2$° C./h to $X_2$° C.

| Alloy No. | Heat treatment | X °C. | Y h | $Z_1$ °C./h | $X_1$ °C. | $Z_2$ °C/h | $X_2$ °C. | $R_m$ N/mm² | $R_{p0.2}$ N/mm² | $A_5$ % | Z % | Hv30 |
|---|---|---|---|---|---|---|---|---|---|---|---|---|
| | c | 730 | 8 | 15 | 580 | — | — | 1246 | 955 | 12.5 | 13.0 | 414 |
| | d | 730 | 4 | 5 | 700 | 15 | 580 | 1071 | 625 | 31.0 | 30.0 | 298 |

TABLE 5

Mechanical properties at 260° C.
Heat treatment: (last step always air cooling)
a) Hot shaping, solution annealing and aging for Y hours at X° C., followed by controlled cooling with $Z_1$° C./h to $X_1$° C.,
b) Hot shaping, water quenching, aging for Y hours at X° C., followed by controlled cooling with $Z_1$° C./h to $X_1$° C.

| Alloy No. | Heat treatment | X °C. | Y h | $Z_1$ °C./h | $X_1$ °C. | $R_m$ N/mm² | $R_{p0.2}$ N/mm² | $A_5$ % | Z % | Hv30* |
|---|---|---|---|---|---|---|---|---|---|---|
| 3 | b | 730 | 8 | 15 | 580 | 980 | 540 | 34.0 | 43.0 | 321 |
| | c | 730 | 8 | 15 | 580 | 1072 | 794 | 22.5 | 33.0 | 393 |
| | b | 750 | 4 | 15 | 600 | 1002 | 569 | 28.0 | 38.0 | 359 |
| | c | 750 | 4 | 15 | 600 | 1069 | 874 | 21.0 | 34.0 | 411 |
| 5 | b | 730 | 8 | 15 | 600 | 1084 | 593 | 31.5 | 32.0 | 341 |
| | c | 730 | 8 | 15 | 600 | 1135 | 866 | 14.0 | 21.0 | 393 |
| | b | 750 | 4 | 15 | 600 | 1139 | 650 | 27.5 | 31.0 | 354 |
| | c | 750 | 4 | 15 | 600 | 1155 | 938 | 15.0 | 25.0 | 432 |

*) = Hardness measurement performed at ET

TABLE 6

Mechanical properties at room temperature (RT)
Heat treatment:
c) Hot shaping, water quenching, aging for Y hours at X° C., then controlled cooling with $Z_1$° C. to $X_1$° C., then air cooling

| Alloy No. | Heat treatment | X °C. | Y h | $Z_1$ °C./h | $X_1$ °C. | $R_m$ N/mm² | $R_{p0.2}$ N/mm² | $A_5$ % | Z % |
|---|---|---|---|---|---|---|---|---|---|
| 2 | c | 730 | 4 | 15 | 580 | 1019 | 679 | 40.0 | 60.0 |
| | c | 730 | 8 | 15 | 580 | 1083 | 863 | 32.0 | 49.0 |
| | c | 750 | 4 | 15 | 600 | 1109 | 820 | 28.5 | 44.0 |
| 4 | c | 730 | 4 | 15 | 580 | 1108 | 822 | 29.0 | 44.0 |
| | c | 730 | 8 | 15 | 580 | 1145 | 939 | 25.5 | 38.0 |
| | c | 750 | 4 | 15 | 600 | 1154 | 912 | 24.5 | 32.0 |

TABLE 7

Mechanical properties at 260° C.
Heat treatment:
c) Hot shaping, water quenching, aging for Y hours at X° C., followed by controlled cooling with $Z_1$° C. to $X_1$° C.

| Alloy No. | Heat treatment | X °C. | Y h | $Z_1$ °C./h | $X_1$ °C. | $R_m$ N/mm² | $R_{p0.2}$ N/mm² | $A_5$ % | Z % |
|---|---|---|---|---|---|---|---|---|---|
| 2 | c | 730 | 4 | 15 | 580 | 822 | 434 | 42/3 | 59.0 |
| | c | 730 | 8 | 15 | 580 | 972 | 768 | 30.5 | 49.0 |
| | c | 750 | 4 | 15 | 600 | 1046 | 693 | 24.0 | 48.0 |
| 4 | c | 730 | 4 | 15 | 580 | 929 | 635 | 37.5 | 48.0 |
| | c | 730 | 8 | 15 | 580 | 1047 | 726 | 23.8 | 36.0 |
| | c | 750 | 4 | 15 | 600 | 1056 | 802 | 18.8 | 36.0 |

TABLE 8

Results of stress corrosion cracking tests
Solution A heated to 232° C.
Test load: 100% $R_{p0.2}$
Heat treatment: heat shaping, water quenching, aging for Y hours at X° C., followed by controlled cooling with $Z_1$° C./h to $X_1$° C., then air cooling

| Alloy No. | X °C. | Y h | $Z_1$ °C./h | $X_1$ °C. | Test load N/mm² | Specimen No. | Results |
|---|---|---|---|---|---|---|---|
| 3 | 730 | 8 | 15 | 580 | 675 | 6 | 26 days/ no failure |

TABLE 8-continued

Results of stress corrosion cracking tests
Solution A heated to 232° C.
Test load: 100% $R_{p0.2}$
Heat treatment: heat shaping, water quenching, aging for Y hours at X° C., followed by controlled cooling with $Z_1$° C./h to $X_1$° C., then air cooling

| Alloy No. | X °C. | Y h | $Z_1$ °C./h | $X_1$ °C. | Test load N/mm² | Specimen No. | Results |
|---|---|---|---|---|---|---|---|
| | | | | | | 7 | 26 days/ no failure |

TABLE 8-continued

Results of stress corrosion cracking tests
Solution A heated to 232° C.
Test load: 100% $R_{p0.2}$
Heat treatment: heat shaping, water quenching, aging for Y hours at X° C., followed by controlled cooling with $Z_1$° C./h to $X_1$° C., then air cooling

| Alloy No. | X °C. | Y h | $Z_1$ °C./h | $X_1$ °C. | Test load N/mm² | Specimen No. | Results |
|---|---|---|---|---|---|---|---|
| | | | | | | 8 | 24 days/ no failure |
| | 750 | 8 | 15 | 600 | 751 | 10 | 26 days/ no failure |
| | | | | | | 11 | 24 days/ no failure |
| | | | | | | 12 | 24 days/ no failure |
| 6 | 730 | 8 | 15 | 580 | 831 | 14 | 26 days/ no failure |
| | | | | | | 15 | 26 days/ no failure |
| | 750 | 8 | 15 | 600 | 887 | 2 | 24 days/ no failure |
| | | | | | | 3 | 24 days/ no failure |
| | | | | | | 4 | 24 days/ no failure |

TABLE 9

Results of stress corrosion cracking tests
Solution A heated to 232° C.
Test load: 120% $R_{p0.2}$
Heat treatment: heat shaping, water quenching, aging for Y hours at X° C., followed by controlled cooling with $Z_1$° C./h to $X_1$° C., then air cooling

| Alloy No. | X °C. | Y h | $Z_1$ °C./h | $X_1$ °C. | Test load N/mm² | Specimen No. | Results |
|---|---|---|---|---|---|---|---|
| 3 | 730 | 8 | 15 | 580 | 675 | 8 | 26 days/ no failure |

TABLE 10

Results of stress corrosion cracking tests
Solution B heated to 232° C.
Test load: 100% $R_{p0.2}$
Heat treatment: heat shaping, water quenching, aging for Y hours at X° C., followed by controlled cooling with $Z_1$° C./h to $X_1$° C., then air cooling

| Alloy No. | X °C. | Y h | $Z_1$ °C./h | $X_1$ °C. | Test load N/mm² | Specimen No. | Results |
|---|---|---|---|---|---|---|---|
| 3 | 750 | 8 | 15 | 600 | 751 | 12 | 23 days/ no failure |

TABLE 11

Results of stress corrosion cracking tests
Solution B heated to 232° C.
Test load: 120% $R_{p0.2}$
Heat treatment: heat shaping, water quenching, aging for Y hours at X° C., followed by controlled cooling with $Z_1$° C./h to $X_1$° C., then air cooling

| Alloy No. | X °C. | Y h | $Z_1$ °C./h | $X_1$ °C. | Test load N/mm² | Specimen No. | Results |
|---|---|---|---|---|---|---|---|
| 3 | 730 | 8 | 15 | 580 | 810 | 8 | 25 days/ no failure |

TABLE 12

Results of stress corrosion cracking tests
Solution B heated to 260° C.
Test load: 100% $R_{p0.2}$
Heat treatment: heat shaping, water quenching, aging for Y hours at X° C., followed by controlled cooling with $Z_1$° C./h to $X_1$° C., then air cooling

| Alloy No. | X °C. | Y h | $Z_1$ °C./h | $X_1$ °C. | Test load N/mm² | Specimen No. | Results |
|---|---|---|---|---|---|---|---|
| 2 | 730 | 8 | 15 | 580 | 780 | 2 | 24 days/ no failure |
| | 750 | 8 | 15 | 600 | 763 | 5 | 25 days/ no failure |
| 3 | 730 | 8 | 15 | 580 | 683 | 26 | 24 days/ no failure |
| 4 | 730 | 8 | 15 | 580 | 772 | 8 | 24 days/ no failure |
| | 750 | 8 | 15 | 580 | 756 | 6 | 25 days/ no failure |
| 5 | 730 | 8 | 15 | 580 | 748 | 34 | 24 days/ no failure |

TABLE 13

Results of stress corrosion cracking tests
Solution B heated to 260° C.
Test load: 120% $R_{p0.2}$
Heat treatment: heat shaping, water quenching, aging for Y hours at X° C., followed by controlled cooling with $Z_1$° C./h to $X_1$° C., then air cooling

| Alloy No. | X °C. | Y h | $Z_1$ °C./h | $X_1$ °C. | Test load N/mm² | Specimen No. | Results |
|---|---|---|---|---|---|---|---|
| 2 | 730 | 8 | 15 | 936 | 936 | 3 | 24 days/ no failure |
| | 750 | 8 | 15 | 600 | 916 | 7 | 25 days/ no failure |
| 3 | 730 | 8 | 15 | 580 | 820 | 27 | 24 days/ no failure |
| 4 | 730 | 8 | 15 | 580 | 926 | 3 | 24 days/ no failure |
| | 750 | 8 | 15 | 600 | 907 | 7 | 25 days/ no failure |
| 5 | 730 | 8 | 15 | 580 | 898 | 35 | 24 days/ no failure |

We claim:

1. A process for the manufacture of structural components which have very good resistance to corrosion and a 0.2% proof stress of at least 500 N/mm², comprising a) producing ingots from an alloy having
43 to 51% nickel
19 to 24% chromium
4.5 to 7.5% molybdenum
0.4 to 2.5% copper
up to 1% manganese
up to 0.5% silicon
up to 0.02% carbon
up to 2% cobalt
0.3 to 1.8% aluminium
0.9 to 2.2% titanium,
balance iron and incidental impurities, b) homogenizing said ingots at 1220° C. and then hot shaping at a temperature above 1000° C. into components, followed by quenching said components in water, and c) precipitation hardening said components for 4 to 16 hours at 650° to 750° C., and then subjecting said components to air cooling.

2. A process according to claim 1 wherein said ingots are produced from an alloy having
43 to 51% nickel 20 to 23.5% chromium
5 to 7% molybdenum
1.5 to 2.2% copper
up to 0.8% manganese
up to 0.1% silicon
up to 0.015% carbon
up to 2% cobalt
0.4 to 0.9% aluminium
1.5 to 2.1% titanium,
balance iron and incidental impurities.

3. A process according to claim 1 or 2, wherein after said components are quenched in water, said components are held for 4 to 10 hours at 700°-750° C., then furnace-cooled by 150° C. at a rate of 5°-25° C. per hour, and thereafter subjected to air cooling.

4. A process according to claim 1 or 2 wherein after said components are quenched in water, said components are held for 30 minutes at 730°-750° C., furnace-cooled to 700° C. at a rate of 5°-25° C. per hour and then to 580° C. at a rate of 2°-15° C. per hour, and thereafter subjected to air cooling.

5. A process according to claim 1 or 2 further comprising solution annealing said components at 1,150° to 1,190° C. prior to quenching said components in water.

6. A process according to claim 5 wherein after said components are quenched in water, said components are held for 4 to 10 hours at 700° to 750° C., then furnace-cooled by 150° C. at a rate of 5°-25° C. per hour, and thereafter subjected to air cooling.

* * * * *